US007901114B2

(12) United States Patent
Lok

(10) Patent No.: US 7,901,114 B2
(45) Date of Patent: Mar. 8, 2011

(54) LIGHTING FIXTURE IRIS POSITIONING APPARATUS

(76) Inventor: Thomas E. Lok, Brookfield, IL (US)

( * ) Notice: Subject to any disclaimer, the term of this patent is extended or adjusted under 35 U.S.C. 154(b) by 512 days.

(21) Appl. No.: 11/944,132

(22) Filed: Nov. 21, 2007

(65) Prior Publication Data

US 2009/0251903 A1 Oct. 8, 2009

Related U.S. Application Data

(60) Provisional application No. 60/866,746, filed on Nov. 21, 2006.

(51) Int. Cl.
*F21V 21/00* (2006.01)

(52) U.S. Cl. ..... 362/388; 362/285; 362/372; 362/418; 362/426; 362/430

(58) Field of Classification Search ..... 362/388, 362/285–289, 372, 418, 419, 426–428, 430
See application file for complete search history.

(56) References Cited

U.S. PATENT DOCUMENTS

| | | | | |
|---|---|---|---|---|
| 2,993,985 | A * | 7/1961 | Scrabonia | 362/26 |
| 3,069,536 | A * | 12/1962 | Dion et al. | 362/280 |
| 3,594,566 | A * | 7/1971 | Kneisley | 362/268 |
| 5,331,523 | A * | 7/1994 | Delzer | 362/96 |
| 5,353,211 | A * | 10/1994 | Merko | 362/294 |
| 6,471,374 | B1 * | 10/2002 | Thomas et al. | 362/285 |
| 6,644,827 | B2 * | 11/2003 | Birdwell | 362/202 |
| 6,974,231 | B2 * | 12/2005 | Burton | 362/273 |

* cited by examiner

*Primary Examiner* — Jong-Suk (James) Lee
*Assistant Examiner* — Mark Tsidulko
(74) *Attorney, Agent, or Firm* — Barnes & Thornburg LLP

(57) ABSTRACT

A positioning apparatus for theatrical lighting equipment. In particular, an apparatus that allows an operator to control the direction of the light beam from a lighting fixture and simultaneously control an iris attached to the lighting fixture.

16 Claims, 7 Drawing Sheets

LIGHTING FIXTURE IRIS POSITIONING APPARATUS

The present application claims the benefit of priority to U.S. Provisional Patent Application Ser. No. 60/866,746, filed Nov. 21, 2006.

BACKGROUND

Typically theatrical lighting fixtures are intended to be fixed in position. However because of their compact size, often a theatrical lighting fixture is used as an improvised spotlight, or follow-spot. Theatrical lighting fixtures are provided with a number of controls for varying the intensity of light output and the size of the light beam. Theatrical lighting fixtures are mounted on a yoke, which allows an operator to direct the light beam up or down and from side to side when used as a spotlight. Theatrical lighting fixtures also have an iris which may be used to increase or decrease the size of the diameter of the light beam. Additionally, theatrical lighting fixtures may have a douser for varying the intensity of the light beam or blocking the light beam entirely. Often, an operator must control these several attributes of a light beam at the same time.

Among these attributes, an operator may be required to vary the position of the light beam, vary the intensity of the light beam, and the size of the light beam simultaneously. Currently, when a theatrical lighting fixture is used as a spotlight, the operator must maintain the position of the light with one hand, leaving the other hand to operate both the iris and the douser, among other functions.

When the lighting fixture is used in a side-lighting capacity, the lighting fixture is operated from the side of the stage, typically above and close to the edge of the proscenium opening. It is possible that in operation, the light will swing through an arc of 70 degrees, while shifting its throw, the distance to the illuminated subject, from approximately 20 to 60 feet. Adjusting the iris continuously and smoothly through this swing is difficult, and may be additionally challenging if there are obstructions that prevent reaching continuously. Conventional theatrical lighting equipment, and in particular the Source Four manufactured by ETC and other ellipsoidal reflector type lighting fixtures equipped with irises, are often used in this application as compact spotlights owing to their small size, allowing the lighting fixture and operator to be placed in a very small space on the proscenium of a stage set. As there are many other devices that also have to be placed on the proscenium of the stage set, space is at a premium, and many obstructions are present.

It is usually left to the operator to devise some method of marking the settings of the iris and douser, either by memory or with small pieces of tape or wire, to form a tactile indicator, as the iris is not usually in the operator's line of sight while operating the light.

Conventional theatrical lighting fixtures are also prone to light leaks, which are made more apparent when the lighting fixture is used as a spotlight. This is because lighting fixtures of this type are generally not designed to function as a spotlight, and therefore light leakage is not likely a primary design consideration. The iris slot must not be obstructed in order to allow unencumbered movement of the iris handle, but light reflects off the internal components of the lighting fixture, leading to light leaks thru the iris slot. When used as intended, the lighting fixture is equipped with a metal cover which is slid over the iris slot. This serves to stop light leafs as well as lock, through friction, the iris. Locking the iris is not always a desirable feature in a spotlight.

Light leakage from a lighting fixture may be manifested by the projection of errant rays of light to on the set in unintended and distracting patterns. The iris slot, thru which the iris handle moves, is a particularly difficult source of light leaks, as the slot cannot be covered with any of the traditional tapes or foils available to the industry, since the iris handle has to be free to move unencumbered through this slot, and additionally, the iris handle must be accessible to the operator's hand at all times.

SUMMARY

The present disclosure relates generally to a positioning apparatus for theatrical lighting equipment. In particular, the present disclosure is for an apparatus that allows an operator to control the direction of the light beam from a lighting fixture and simultaneously control an iris attached to the lighting fixture. This allows an operator to control the direction of the light beam and the size of the diameter of the light beam with one hand, while allowing a free hand to operate other controls, such as a douser to control the intensity of the light beam.

The present disclosure combines the control of the position of a theatrical lighting fixture with the control of the iris, in a motion which is natural and comfortable to the operator, so that by merely pivoting the wrist and hand controlling the position of the light, the operator can adjust the iris size. Single-handed operation of the positioning apparatus of the present disclosure allows the operator to control other aspects of the light, such as color or intensity with their other hand.

In accordance with one aspect of the present disclosure, a linkage is made between the iris of the light and a rotatable shaft which acts as the handle of the spotlight. The handle may be configured so that rotating the handle increases and decreases the iris aperture, thereby increasing and decreasing the diameter of the light beam at the discretion of the operator.

According to another aspect of the present disclosure, a scale may be provided proximate to the iris handle as a reference to the operator for precise iris positioning. The scale may be illuminated or may be constructed of translucent material, and illuminated by a supplemental light source.

According to yet another aspect of the present disclosure, a light baffle may be provided to prevent light leakage from the iris slot on the theatrical lighting fixture.

As used herein, it should be understood that the term "spotlight" is meant to include fixed-mount type theatrical lighting fixtures used as a follow-spot device.

BRIEF DESCRIPTION OF THE DRAWINGS

The present disclosure will be described hereafter with reference to the attached drawings which are given as a non-limiting example only, in which.

DETAILED DESCRIPTION

While the present disclosure will be described fully hereinafter with reference to the accompanying drawings in which particular embodiments are shown, it is understood at the outset that persons skilled in the art may modify the disclosure herein described while still achieving the desired result of this disclosure. Accordingly, the description which follows is to be understood as a broad informative disclosure directed to persons skilled in the appropriate arts and not as limitations of the present disclosure.

Figure 1:
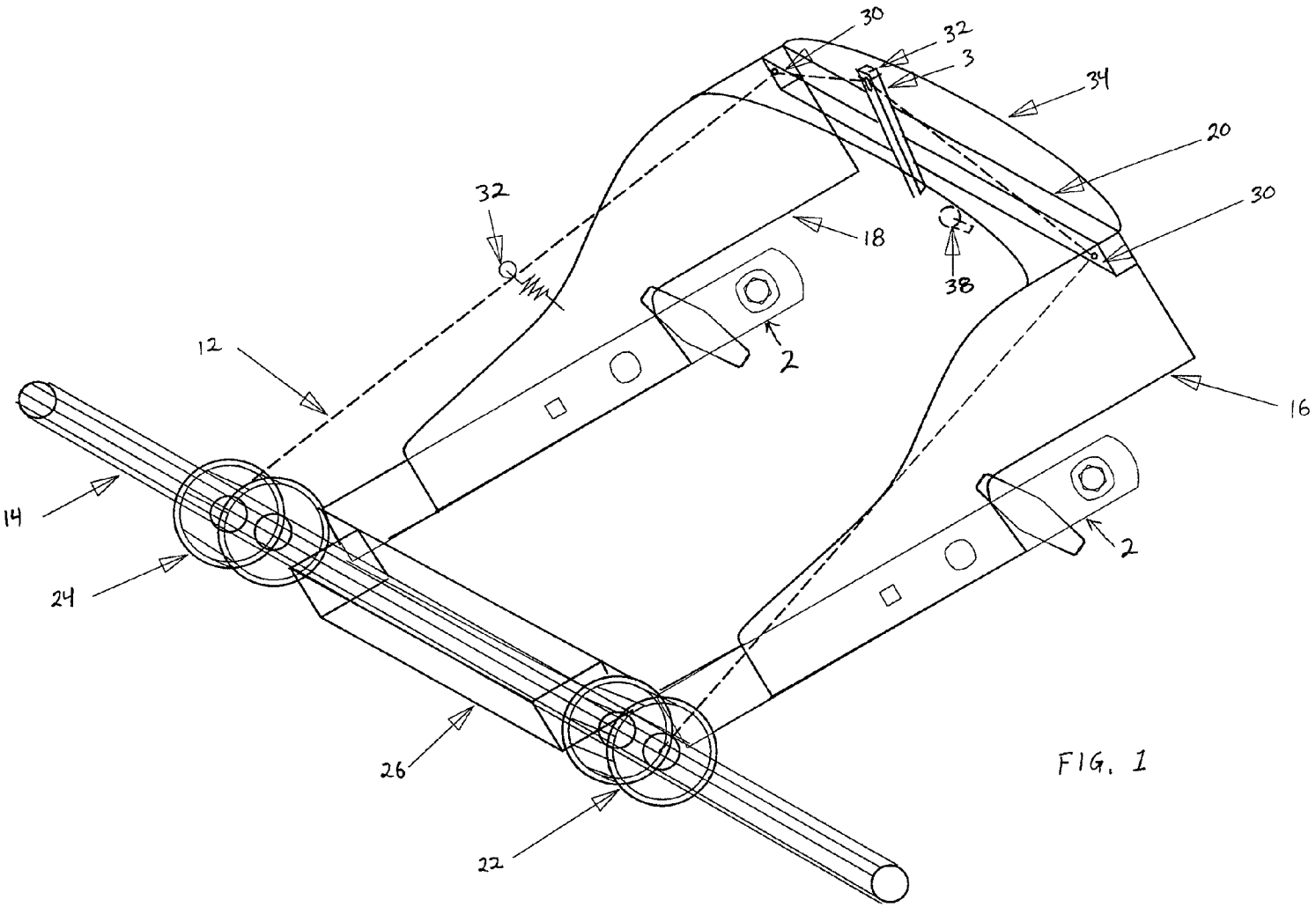
FIG. 1 is a perspective view showing an embodiment of the iris positioning apparatus of the present disclosure.
Figure 2:
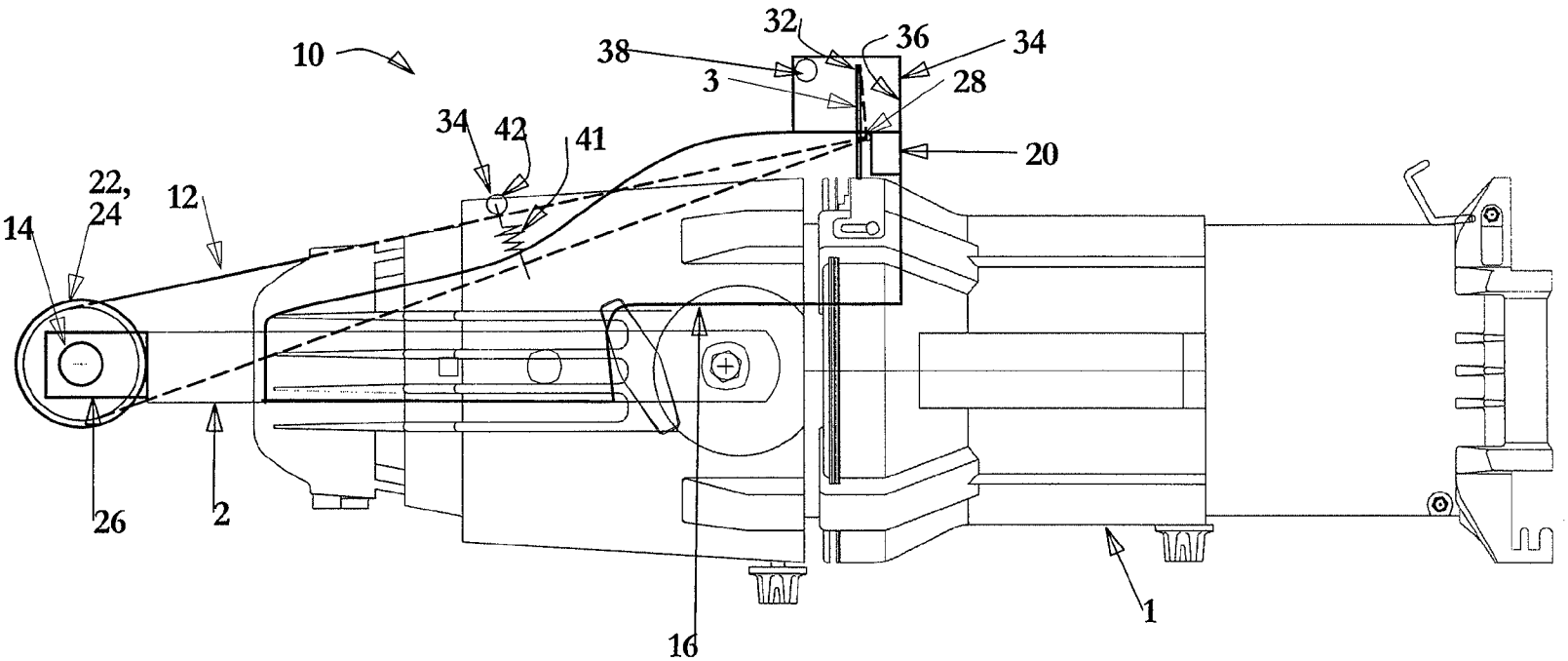
FIG. 2 is a side elevation view showing the iris positioning apparatus of FIG. 1 attached to a lighting fixture.
Figure 3:
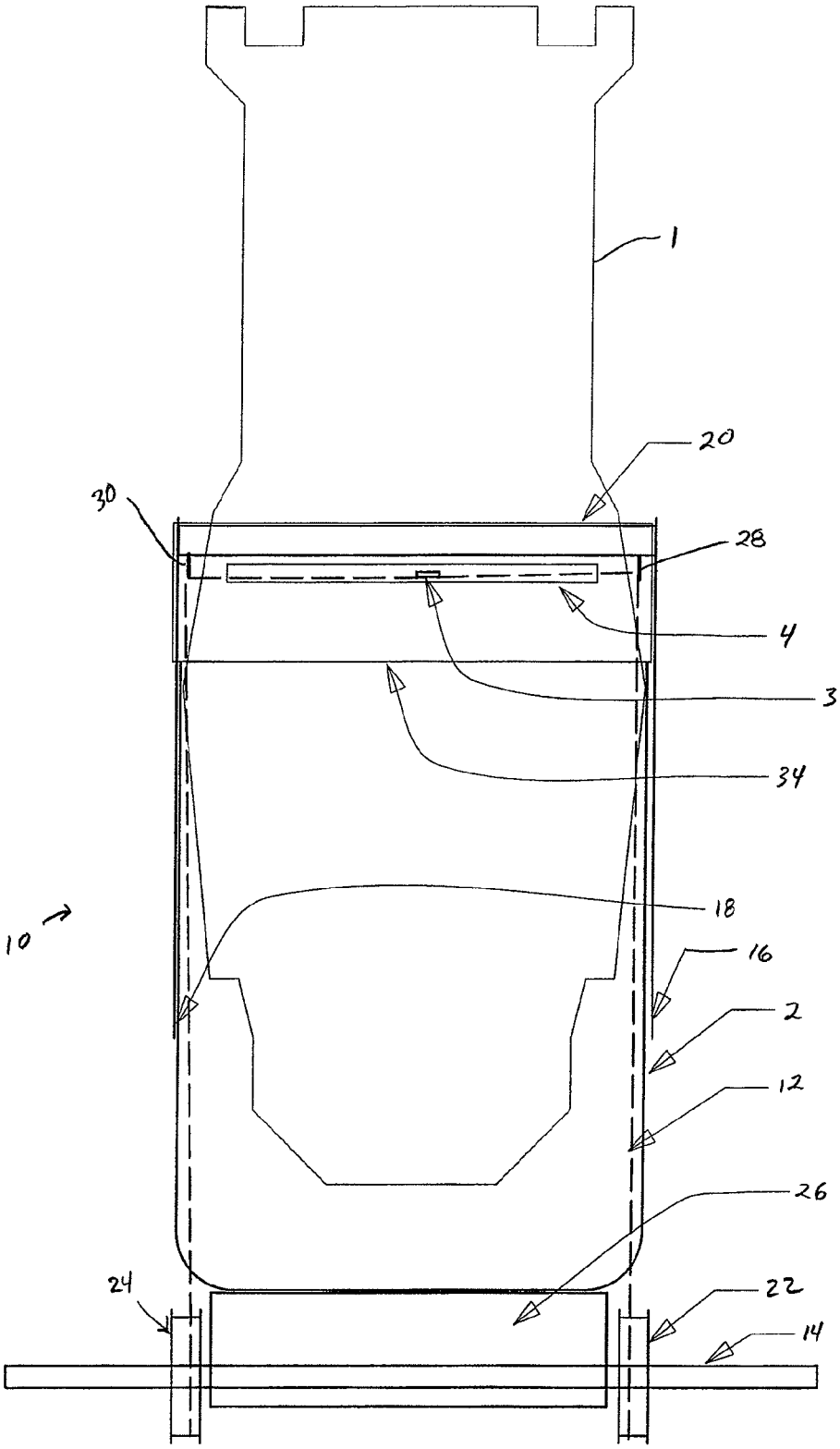
FIG. 3 is a top view of the apparatus of FIG. 1.

Referring to FIGS. 1 through 3, the iris positioning apparatus 10 of the present disclosure is configured to attach to a theatrical lighting fixture 1. The iris positioning apparatus 10 includes a positioner 12 coupled to a positioner control handle 14. Positioner control handle 14 is attached to the yoke 2 of lighting fixture 1.

A pair of side supports 16, 18 are positioned on either side of lighting fixture 1 and coupled to yoke 2. A transverse support 20 is coupled to and positioned between side supports 16 and 18. Transverse support 20 is spaced from the yoke 2 to stabilize side supports 16 and 18.

Positioner control handle 14 is attached to yoke 2, and includes a pair of drums 22, 24, the drums are spaced apart from each other and positioned on opposite sides of positioner control handle 14. Positioner control handle 14 is mounted in a bearing 26 coupled to yoke 2. Positioner 12 is wound about each drum 22, 24 such that as positioner control handle 14 is rotated in a first direction, positioner 12 unwinds from drum 22 while simultaneously winds onto drum 24. Likewise, as positioner control handle 14 is rotated in a second direction, positioner 12 winds onto drum 22, while simultaneously unwinding from drum 24.

It is desirable that the rotation of the handle 14 not greatly exceed the rotation of the human wrist. However, the length of the arc of the iris handle 3 is close to 6 inches, while a comfortable handle diameter is approximately ¾ inch to 1 inch. Therefore, the pair of drums 22, 24 are used to increase the arc length generated by the operator while turning the positioner control handle 14. In the present embodiment, each drum 22, 24 is sized with a diameter of 2 inches allowing operability over the total length of the arc of the iris handle.

Conversion of the rotational movement of positioner control handle 14 to position iris handle 3 may also be accomplished by other mechanical methods, such as with bevel gears and a shaft extending to the rotational plane of the iris, or by other methods known to those skilled in the art.

In the exemplary embodiment, positioner 12 comprises a length of cord such as polypropylene, polyester, nylon or combinations thereof. Positioner 12 may also comprise wire rope, cable, rubber belts, and other embodiments known to those skilled in the art.

Because the rotational axis of the positioner control handle 14 is oriented perpendicular to the rotational axis or the iris handle 3, the rotation applied to the handle must be oriented to the iris. Positioner guides 28, 30 are provided at the distal end of each side support 16, 18 near the iris handle 3 of lighting fixture 1. In the present embodiment, positioner guides 28, 30 each comprise an eyebolt. Positioner 12 is arranged to pass through positioner guide 28, 30 which redirect positioner 12 from drums 22, 24 into alignment with iris handle 3.

Figure 4:
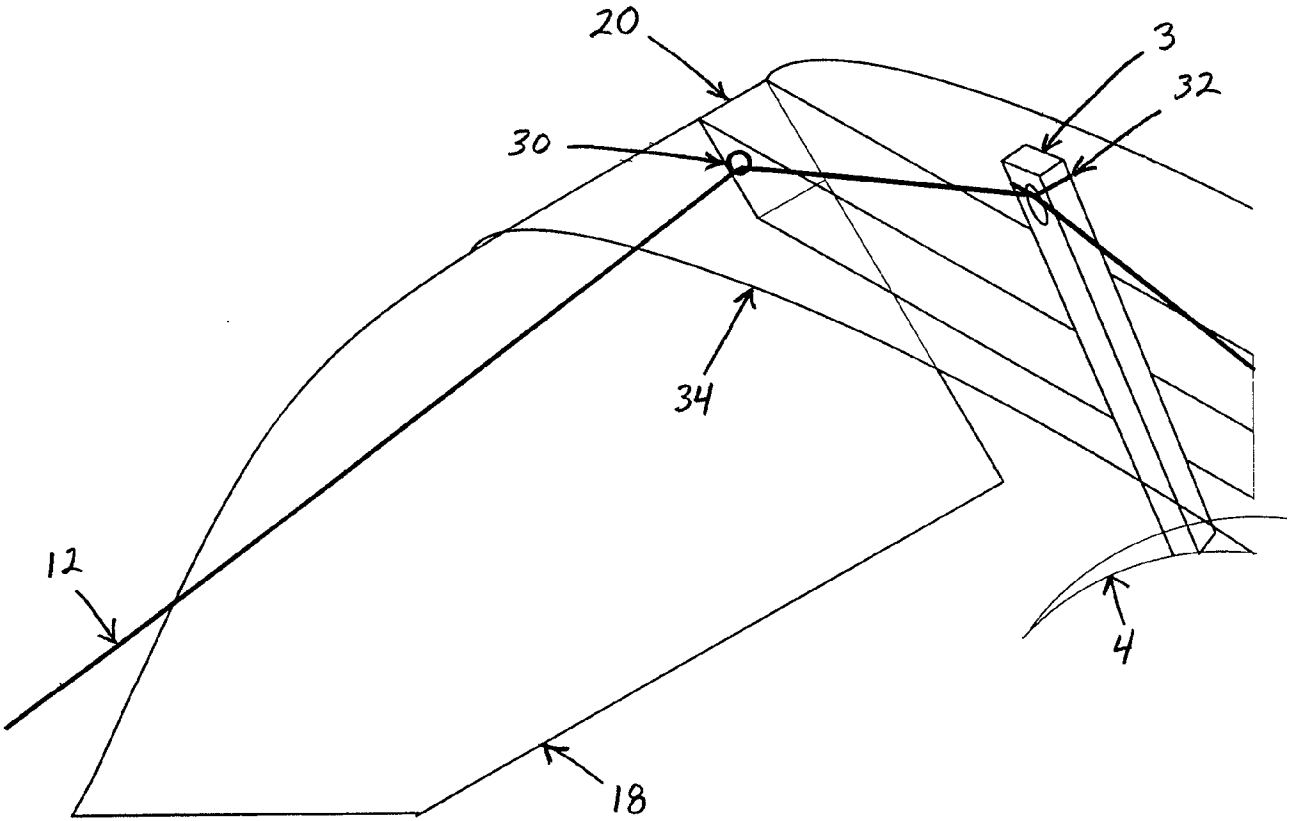
FIG. 4 is a detailed perspective view showing the attachment of the positioner to the iris handle.

Positioner 12 is configured to be wound about drum 22, through positioner guide 28, attached to iris handle 3, through positioner guide 30, and wound about drum 24. As shown in FIG. 4, coupling 32 attaches positioner 12 to iris handle 3. Coupling 32 may simply be a knot tying positioner 12 to iris handle 3. Alternatively, coupling 32 may comprise clamps or fasteners known in the art.

A tensioner 32 may be provided to maintain tension on positioner 12, preventing positioner 12 from becoming slack. In the present embodiment, tensioner 32 comprises a spring 40 and pulley 42. At one end, spring 40 is coupled to side support 16, the other end includes pulley 42 that engages positioner 12. A tensioner may also be provided on side support 18 as well, balancing the tension in positioner 12.

Referring to FIG. 2, the present disclosure may also include a scale 36 proximate to iris handle 3 allowing an operator to determine the position of the iris handle and to make fine adjustments. A scale illuminator 38 may also be provided. In many instances, the operator of the lighting fixture is in a dark environment, therefore it is advantageous to have an illuminated scale. In the exemplary embodiment, the scale 36 is positioned on the inside surface of transverse support 20 facing the operator so that the iris handle 3 is between the operator and the scale 36. Scale 36 may be annotated with various iris settings. Scale 36 may also be made of a light conducting material, such as polycarbonate thermoplastic, one example is sold under the trade name LEXAN® by the General Electric Company, allowing the annotations on scale 36 to be readily visible in the dark with additional illumination of scale illuminator 38.

The present disclosure may also include a light baffle 34, as shown in FIGS. 1 and 4. Light baffle 34 is positioned over the top of the iris handle 3 and iris slot 4. Light baffle 34 reduces errant light leaks from iris slot 4 while still permitting full movement and operation of the iris handle 3.

The iris positioning apparatus 10 of the present disclosure is mounted to a theatrical lighting fixture 1 allowing an operator to simultaneously adjust the orientation of the light beam and the size of the light beam. By grasping positioner control handle 14, the operator may pivot lighting fixture 1 up and down or from side to side on yoke 2. At the same time the operator may rotate handle 14. By rotating positioner control handle 14 in a first direction, the operator unwinds positioner 12 from drum 22 while simultaneously winding positioner 12 onto drum 24, which causes iris handle 3 to move, adjusting the iris and therefore the size of the light beam. By rotating positioner control handle 14 in a second direction, the operator winds positioner 12 onto drum 22 while simultaneously unwinding positioner 12 from drum 24, which causes iris handle 3 to move in an opposite direction, adjusting the iris and therefore the size of the light beam. Because drums 22 and 24 are both mounted on positioner control handle 14, the operator may rotate both drums, and thus control the size of the light beam with one hand while controlling the direction of the light with the same hand. This allows the operator to use the other hand for other controls.

Figure 5:
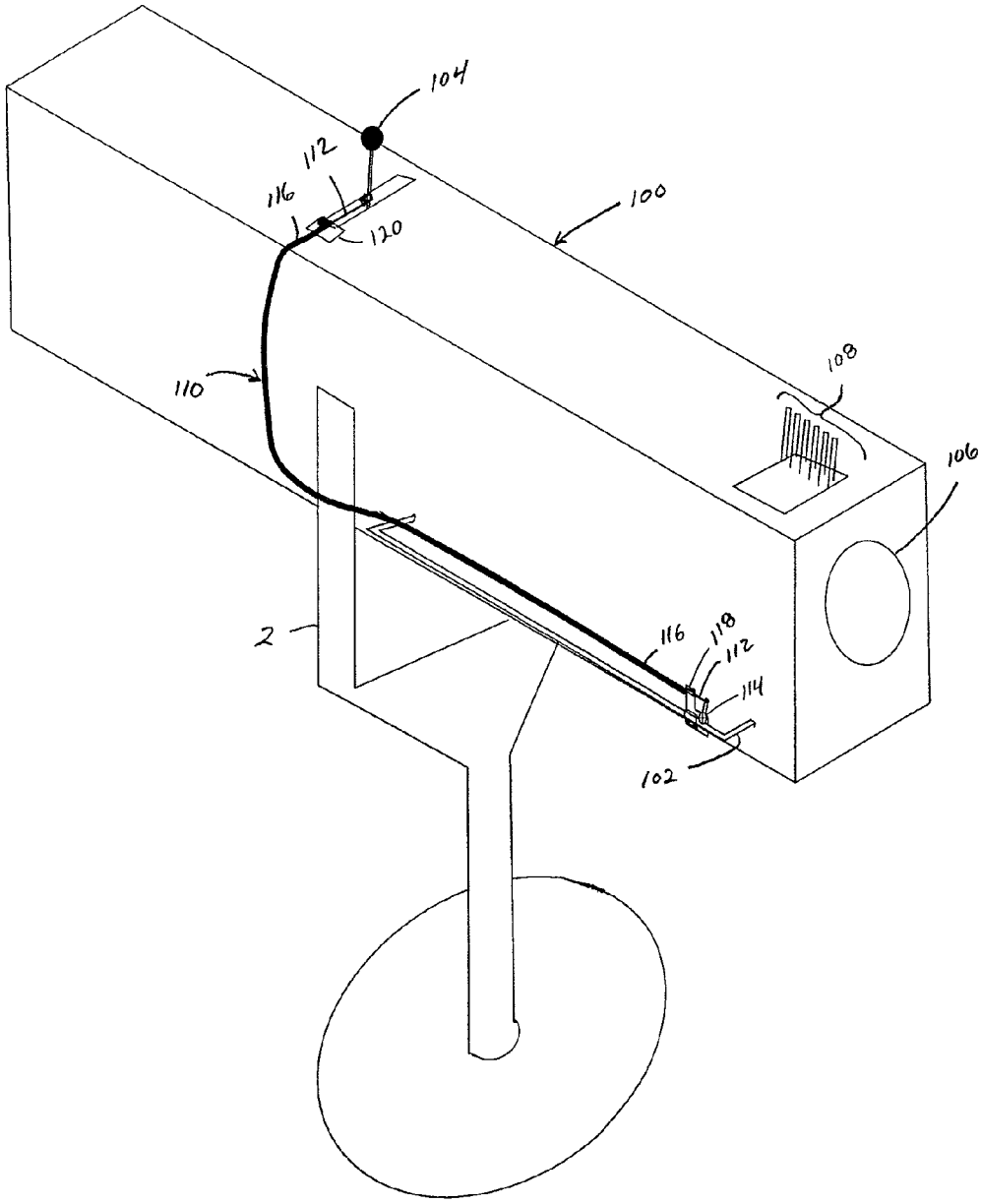
FIG. 5 is a perspective view showing another embodiment of the iris positioning device of the present disclosure.
Figure 6:
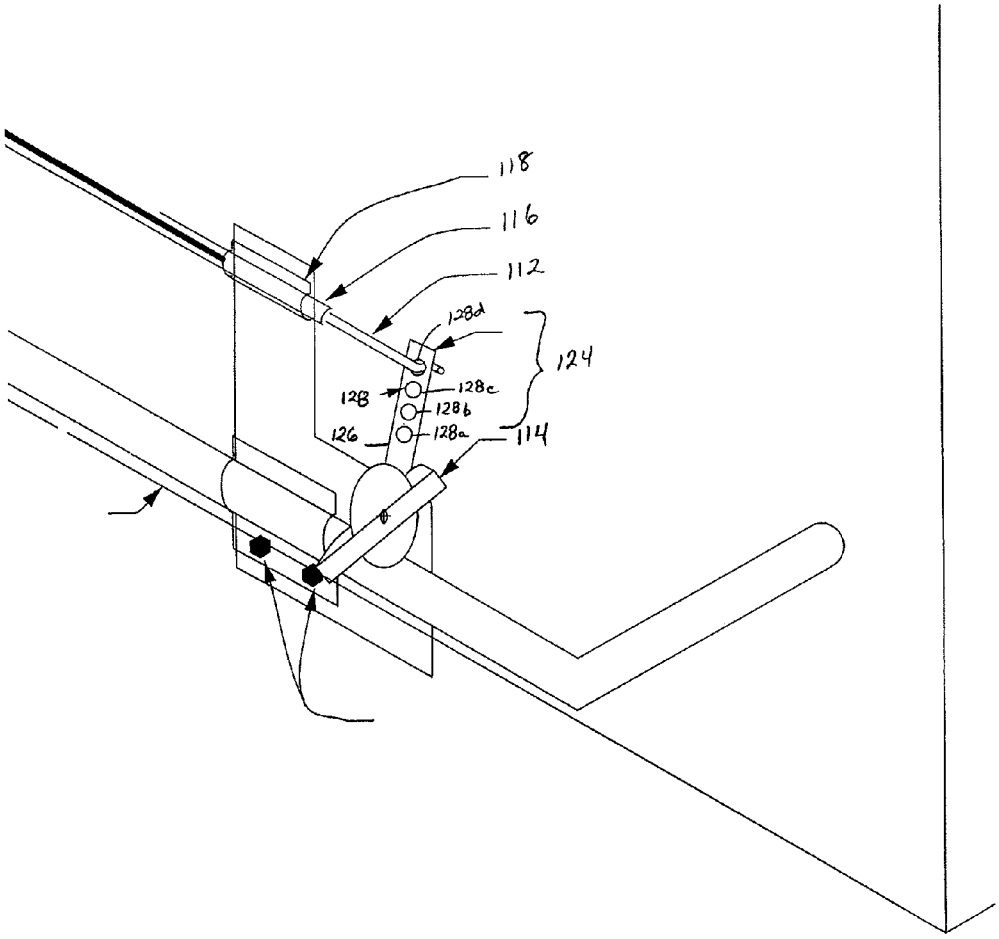
FIG. 6 is a detailed view of the control assembly of the iris positioning device of FIG. 5.
Figure 7:
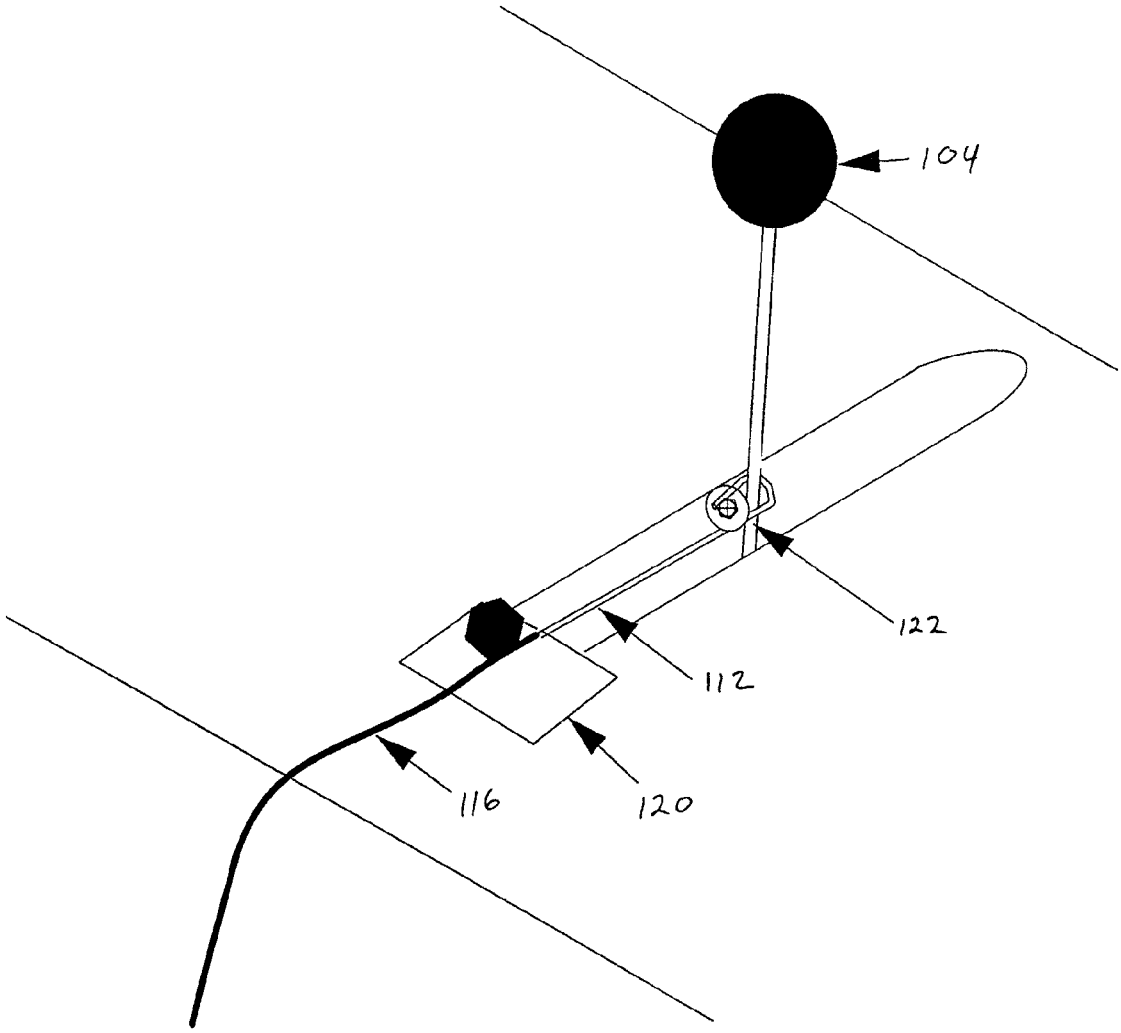
FIG. 7 is a detailed view of the attachment of the positioner of FIG. 5 to the iris handle.

In another embodiment of the present disclosure, as shown in FIGS. 5-7 is adapted for use with traditional theatrical spotlights. A spotlight 100 including a spotlight handle 102 and an iris handle 104 is shown in FIG. 5. Located at a forward end of spotlight 100 is a lens 106 and a color changer 108. The color changer 108 having a number of color filters for changing the color of the light beam of the spotlight 100.

In this exemplary embodiment of the present disclosure, iris positioning apparatus 110 includes a positioner 112 coupled to a handle 114 at the forward end of spotlight 100. Positioner 112 is also coupled to the iris handle 104. In this exemplary embodiment, positioner 112 may be a rigid or semi-rigid member. As shown in FIGS. 5-7, positioner 112 may include a push rod disposed within a guide tube 116. Guide tube 116 is attached to the spotlight 100 at attachment points 118, 120 by, for example, a removable bracket or clamp. Positioner 112 may be attached to a shaft 122 of iris handle 104.

Positioner 112 may also include an adjustment assembly 124 to vary the amount of travel of positioner 112 for a given angle of rotation of handle 114. Adjustment assembly includes an arm 126 having a number of apertures 128 positioned along the length of arm 126 configured to receive positioner 112. Positioner 112 may be disposed within one of the apertures 128. The travel of positioner 112 may be adjusted by changing the aperture 128. In the exemplary embodiment, the adjustment assembly 124 includes an arm 126 having apertures 128*a*, 128*b*, 128*c*, and 128*d*. For a given angular rotation of handle 114, positioner 112 will have a greater travel when configured at aperture 128*d* than 128*a*.

Positioner 112 allows an operator to control the positioning of a light beam from a spotlight 100 as well as another attribute of the beam, such as the intensity or the iris size (and thus the diameter of the beam) with a single hand. This is advantageous as typical large followspots are six feet or more in length and the distance between the color-changer 108 and the iris handle 104 may be over three feet. In addition, due to the mass and hence inertia of the unit, the spotlight can be more easily moved with a hand grasping the light closer to the color changer 108. The iris handle is more commonly near the center of the unit. Multiple devices of this sort can be attached to the theatrical spotlight to control various attributes of the light, or a clutch and system of levers could be arranged to control several attributes of the light with a single handle.

This technology may also be applied to a fresnel type light, where the rotation of the handle could be used to control the spot/flood characteristics of the light, or it could be applied to an existing lighting fixture enabling the operator to control aspects of the light such as iris or douser with the same hand which is controlling the position of the light.

Additionally, it should be clear to one skilled in the art that the subject matter of the present disclosure may be incorporated into the construction theatrical lighting fixtures, or may be incorporated into a kit for attachment to existing lighting fixtures.

The invention claimed is:

1. An apparatus for positioning a theatrical lighting fixture, the lighting fixture being mounted on a yoke for variable orientation, and having an iris disposed within a housing for controlling a beam of light produced by the lighting fixture, the iris having a handle protruding from the housing, the apparatus comprising:

a positioner control handle attached to the lighting fixture;

a pair of side supports mounted on either side of the lighting fixture;

a positioner guide mounted on each side support proximate to the iris handle;

a positioner comprising a flexible member coupled to each of the positioner control handle and the iris handle, and in cooperation with the positioner guides allowing for simultaneous control of the iris and orientation of the lighting fixture; and a tensioner configured to prevent slack in the positioner.

2. The apparatus for positioning a theatrical lighting fixture of claim 1 wherein the positioner control handle further includes a drum mounted at each end of positioner control handle, each drum configured to receive an end the positioner wound about each drum.

3. The apparatus for positioning a theatrical lighting fixture of claim 1 further comprising a scale proximate to the iris handle configured to allow an operator to determine the position of the iris handle.

4. The apparatus for positioning a theatrical lighting fixture of claim 3 further comprising a scale illuminator.

5. The apparatus for positioning a theatrical lighting fixture of claim 1 further comprising a light baffle disposed about the iris handle, wherein the light baffle is configured to contain light escaping the housing proximate to the iris handle while permitting full movement of the iris handle.

6. An apparatus for positioning a theatrical lighting fixture, the lighting fixture having an iris disposed within a housing for controlling a beam of light produced by the lighting fixture, the iris having a handle protruding from the housing, the apparatus comprising:

a positioner control handle mounted on the light fixture;

a positioner having two ends, the positioner being coupled at one end to the positioner control handle and the positioner being coupled at the other end to the iris; and an adjustment assembly coupled to the positioner control handle, the adjustment assembly comprising an arm defining a plurality of apertures, the arm coupled to the positioner control handle, the apertures configured to removably receive and retain an end of the positioner, wherein the apertures are disposed at increasing distance from the positioner control handle.

7. The apparatus for positioning a theatrical lighting fixture of claim 6 wherein the positioner is disposed within a guide tube.

8. The apparatus for positioning a theatrical lighting fixture of claim 6 further comprising a scale proximate to the iris handle configured to allow an operator to determine the position of the iris handle.

9. The apparatus for positioning a theatrical lighting fixture of claim 8 further comprising a scale illuminator.

10. The apparatus for positioning a theatrical lighting fixture of claim 6 further comprising a light baffle disposed about the iris handle, wherein the light baffle is configured to contain light escaping the housing proximate to the iris handle while permitting full movement of the iris handle.

11. An apparatus for positioning a theatrical lighting fixture, the lighting fixture being mounted on a yoke for variable orientation, and having an iris disposed within a housing for controlling a beam of light produced by the lighting fixture, the iris having a handle configured having a first rotational axis and protruding from the housing, the apparatus comprising:

a positioner control handle attached to the lighting fixture, the positioner control handle configured having a second rotational axis;

a pair of side supports mounted on either side of the lighting fixture;

a positioner guide mounted on each side support proximate to the iris handle; and a tensioner in cooperation with a positioner, the positioner coupled to each of the positioner control handle and the iris handle, wherein the positioner in cooperation with the positioner guides allows simultaneous control of the iris and orientation of the lighting fixture, wherein the first rotational axis and the second rotational axis are oriented transverse to each other, and wherein the apparatus is configured for removable attachment to the theatrical lighting fixture.

12. The apparatus for positioning a theatrical lighting fixture of claim 11 wherein the positioner control handle further includes a drum mounted at each end of positioner control handle, each drum configured to receive an end of the positioner wound about each drum.

13. The apparatus for positioning a theatrical lighting fixture of claim 11 wherein the positioner comprises a flexible member.

14. The apparatus for positioning a theatrical lighting fixture of claim 11 further comprising a scale proximate to the iris handle configured to allow an operator to determine the position of the iris handle.

15. The apparatus for positioning a theatrical lighting fixture of claim 14 further comprising a scale illuminator.

16. The apparatus for positioning a theatrical lighting fixture of claim 11 further comprising a light baffle disposed about the iris handle, wherein the light baffle is configured to contain light escaping the housing proximate to the iris handle while permitting full movement of the iris handle.

* * * * *